US007680448B2

(12) United States Patent
Mandel et al.

(10) Patent No.: US 7,680,448 B2
(45) Date of Patent: Mar. 16, 2010

(54) PRINTING INTEGRATION SYSTEM

(75) Inventors: Barry Paul Mandel, Fairport, NY (US); Steven Robert Moore, Pittsford, NY (US); Martin Krucinski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 183 days.

(21) Appl. No.: 11/953,275

(22) Filed: Dec. 10, 2007

(65) Prior Publication Data

US 2009/0146371 A1 Jun. 11, 2009

(51) Int. Cl.
*B65H 9/00* (2006.01)
*G03G 15/00* (2006.01)

(52) U.S. Cl. ..... 399/381; 399/388; 271/301; 271/303

(58) Field of Classification Search ..... 271/186, 271/303, 301; 399/361, 381, 388, 69
See application file for complete search history.

(56) References Cited

U.S. PATENT DOCUMENTS

| | | | | |
|---|---|---|---|---|
| 5,794,931 | A | 8/1998 | Heilman et al. | |
| 6,101,364 | A * | 8/2000 | Boehmer et al. | 399/361 |
| 6,988,729 | B2 | 1/2006 | Tamura et al. | |
| 7,024,152 | B2 | 4/2006 | Lofthus et al. | |
| 7,123,873 | B2 * | 10/2006 | deJong et al. | 399/381 |
| 7,136,616 | B2 * | 11/2006 | Mandel et al. | 399/388 |
| 7,245,844 | B2 * | 7/2007 | de Jong et al. | 399/69 |
| 7,421,241 | B2 * | 9/2008 | deJong et al. | 399/381 |

* cited by examiner

*Primary Examiner*—Kaitlin S Joerger
(74) *Attorney, Agent, or Firm*—Fay Sharpe LLP

(57) ABSTRACT

This disclosure relates to a printing integration system. Specifically, this disclosure provides a means to integrate one or more pairs of substantially vertically aligned marking engines using an intersection transport. The intersection transport includes a media sheet input intersection transport, a single horizontal transport, and a media sheet output intersection transport.

16 Claims, 15 Drawing Sheets

PRINTING INTEGRATION SYSTEM

BACKGROUND

This disclosure relates to printing systems which vertically integrate a plurality of printing devices.

Conventionally, vertically integrated printing devices, also referred to as IMEs (Image Marking Engines) are integrated by means of multiple media paths to provide inter-IME routing of media sheets for marking.

One example of a conventional printing system which includes vertically integrated IMEs is illustrated in FIG. 1.

The printing system includes a first sheet feeder module 2, a second sheet feeder module 4, a first interface module 6, a user terminal 8, a first IME 10, a second IME 12, a third IME 14, a fourth IME 16, a second interface module 20, a first sheet stacker module 24, a second sheet stacker module 26 and an intersection transport module 18 which integrates IMEs 10, 12, 14 and 16, and provides media sheet routing between the IMEs and interface modules 6 and 20.

To provide sheet routing from the first interface module 6 to IMEs 10, 12, 14 and 16, and from the IMEs to the second interface module 20, the intersection module 18 includes forward sheet highways on the top and bottom, and a return highway in the center of the intersection module 18. Notably, these sheet highways are unidirectional.

Another example of a conventional printing system which includes vertically integrated IMEs is illustrated in FIG. 2. This system includes a sheet feeder module 40, a first interface module 42, a user terminal 44, a first IME 46, a second IME 48, a second interface module 52, a third interface module 54, a sheet stacker module 56 and an intersection module 39. The intersection module 39 provides routing of media sheets from the first interface module 42 to IMEs 46 and 48, and to the second interface module 52.

With reference to FIG. 3, illustrated is a detailed view of the intersection module 39 illustrated in FIG. 2. The intersection module 39 includes a top sheet highway 28 which directs media sheets in a forward direction, a middle sheet highway 30 which provides a return path for duplex printing sheet recirculation, and a bottom sheet highway 32 which directs media sheets in a forward direction. Gates 31 and 33 provide the routing of media sheets to and from the interface modules 42 and 52, and provide routing of sheets between media sheet highways 28, 30 and 32. Notably, the media sheet highways are unidirectional.

With reference to FIG. 4, illustrated is another example of a conventional printing system which includes multiple media sheet highways to vertically integrate a plurality of IMEs. The printing system includes a first interface module 60, a first IME 62, a second IME 64, a third IME 66, a fourth IME 68 and a second interface module 70. In addition, integrated within this printing system is a top return highway 72, a middle return highway 74, a middle forward highway 76 and a bottom forward highway 78. Notably, in this example, the media sheet highways are integrated within the IMEs and are unidirectional.

In operation, the printing system highways, i.e. 72, 74, 76 and 78, provide routing of media sheets from the first interface module 60 to IMEs 62, 64, 66 and 68, and to the second interface module 70.

As will be understood by those of ordinary skill in the art of printing systems, the multiple highway structures shown in FIGS. 1-4 are necessary to enable the vertically integrated printing systems to provide a variety of printing modes which utilize one or more IMEs. Examples of the provided printing modes include simplex printing, duplex printing, overlay printing with two or more IMEs, etc.

This disclosure provides a method and system to vertically integrate IMEs in a modular fashion, where a single bidirectional path operatively connected to a pair of intersection transports provides the routing of media sheets between the IMEs. Since the single bidirectional path can serve the same function as the previously described multiple unidirectional highways, the resulting system can be made more compact and at lower cost.

INCORPORATION BY REFERENCE

U.S. Pat. No. 7,136,616, issued to Mandel et al. on Nov. 14, 2006, entitled "PARALLEL PRINTING ARCHITECTURE USING IMAGE MARKING ENGINE MODULES"; and U.S. Pat. No. 7,024,152, issued to Lofthus et al. on Apr. 4, 2006, entitled "PRINTING SYSTEM WITH HORIZONTAL HIGHWAY AND SINGLE PASS DUPLEX," are totally incorporated herein by reference.

BRIEF DESCRIPTION

In one embodiment of this disclosure, a printing system is disclosed. The printing system comprises one or more pairs of marking engines, each pair of marking engines comprising two substantially vertically aligned marking engines, wherein the respective inputs and output paths associated with the substantially vertically aligned marking engines are substantially vertically aligned, and each pair includes an upper marking engine and a lower marking engine; an input and output intersection transport associated with each pair of marking engines and operatively connected to the respective upper and lower marking engine inputs and outputs; and a single horizontal transport operatively connected to the input and output intersection transports, and directing media in a forward direction from the input intersection transport to the output intersection transport, wherein the input intersection transport is adapted to accept input media sheets from a common input and direct the input media sheets to the upper marking engine, the horizontal transport and the lower marking engine, and the output intersection transport is adapted to direct media sheets from the upper marking engine, the horizontal transport and the lower marking engine to a common output.

In another embodiment of this disclosure, a xerographic printing system is disclosed. The printing system comprises a sheet feeder module; an intersection transport module operatively connected to the sheet feeder module, the intersection transport module comprising an input intersection transport; and a single horizontal transport operatively connected to the input intersection transport; and an output intersection transport operatively connected to the single horizontal transport. The printing system further comprises one pair of marking engines operatively connected to the intersection transport module, the pair of marking engines comprising two substantially vertically aligned marking engines, wherein the respective input and output paths associated with the substantially vertically aligned marking engines are substantially vertically oriented, the pair includes an upper marking engine and a lower marking engine, and the respective upper and lower marking engine input and output paths are operatively connected to the respective input intersection transport and output intersection transport; and a sheet output module operatively connected to the output intersection transport associated with the intersection transport module.

In another embodiment of this disclosure, a printing system intersection transport is disclosed. The printing system intersection transport comprises an upper substantially triangular shaped structure; and a lower substantially triangular shaped structure, wherein a first facet associated with the upper and lower substantially triangular shaped structures are aligned to provide an inner guide for directing a media sheet.

DETAILED DESCRIPTION

As briefly discussed in the background section, this disclosure relates to the vertical integration of a plurality of IMEs. Specifically, the exemplary embodiments disclosed herein provide a means for vertically integrating IMEs using a pair of intersection transports where the intersection transports are operatively connected to a single horizontal media sheet transport. Furthermore, the routing capability of the intersection transport enables a bidirectional horizontal transport to route sheets in a reverse direction for duplex printing.

Figure 1:
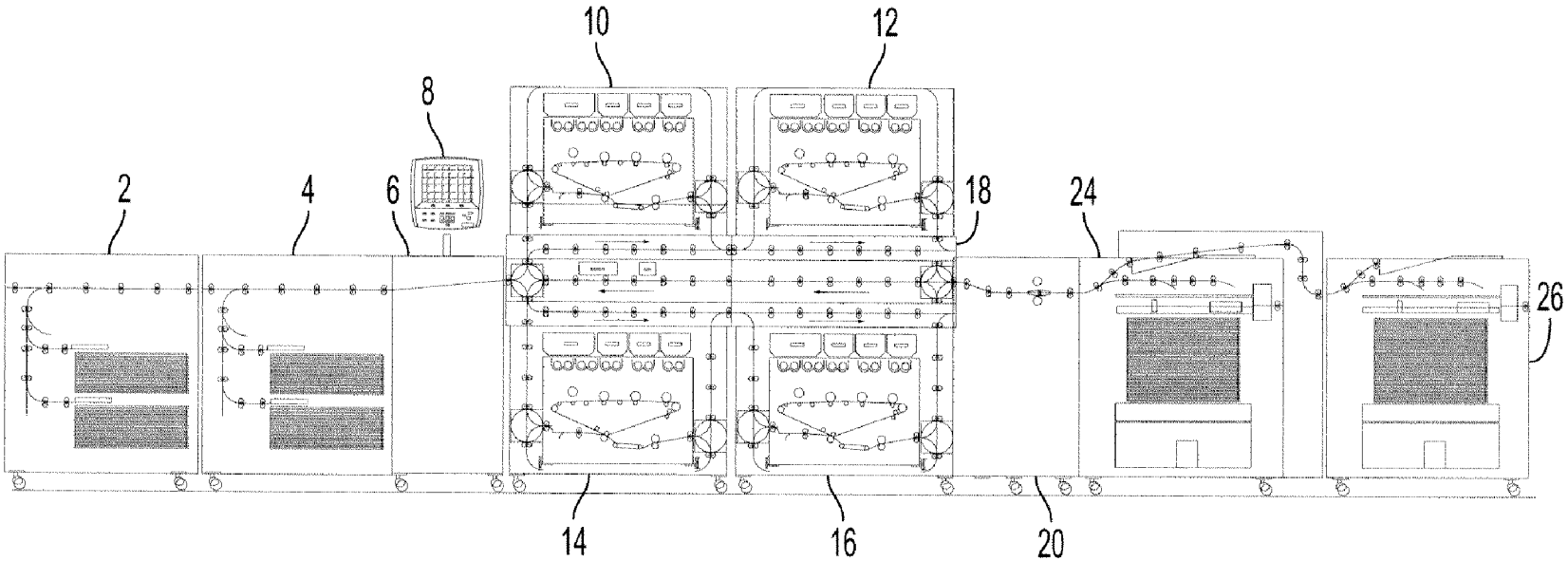
FIG. 1 illustrates a conventional four IME printing system.
Figure 2:
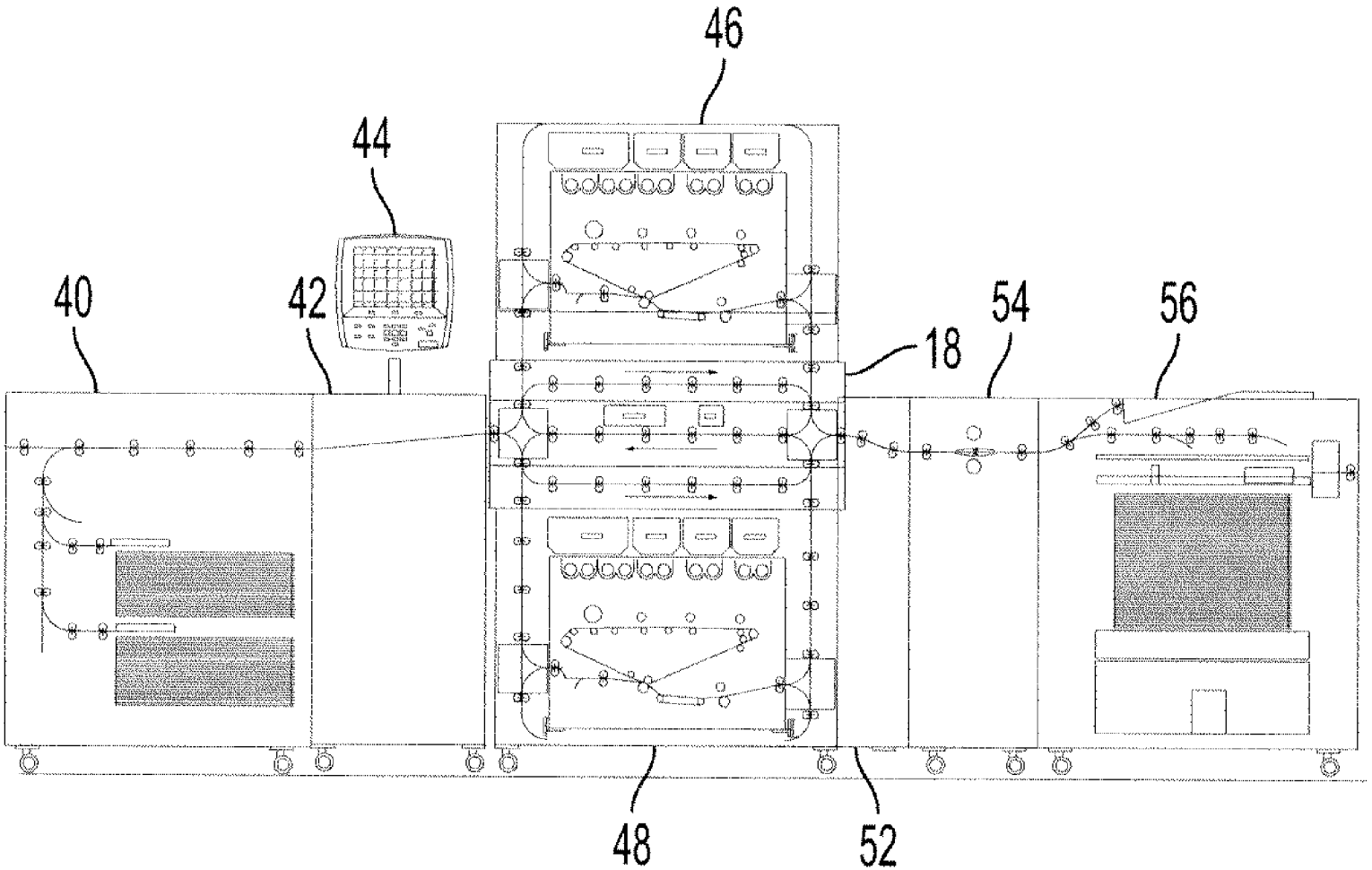
FIG. 2 illustrates a conventional two IME printing system.
Figure 3:
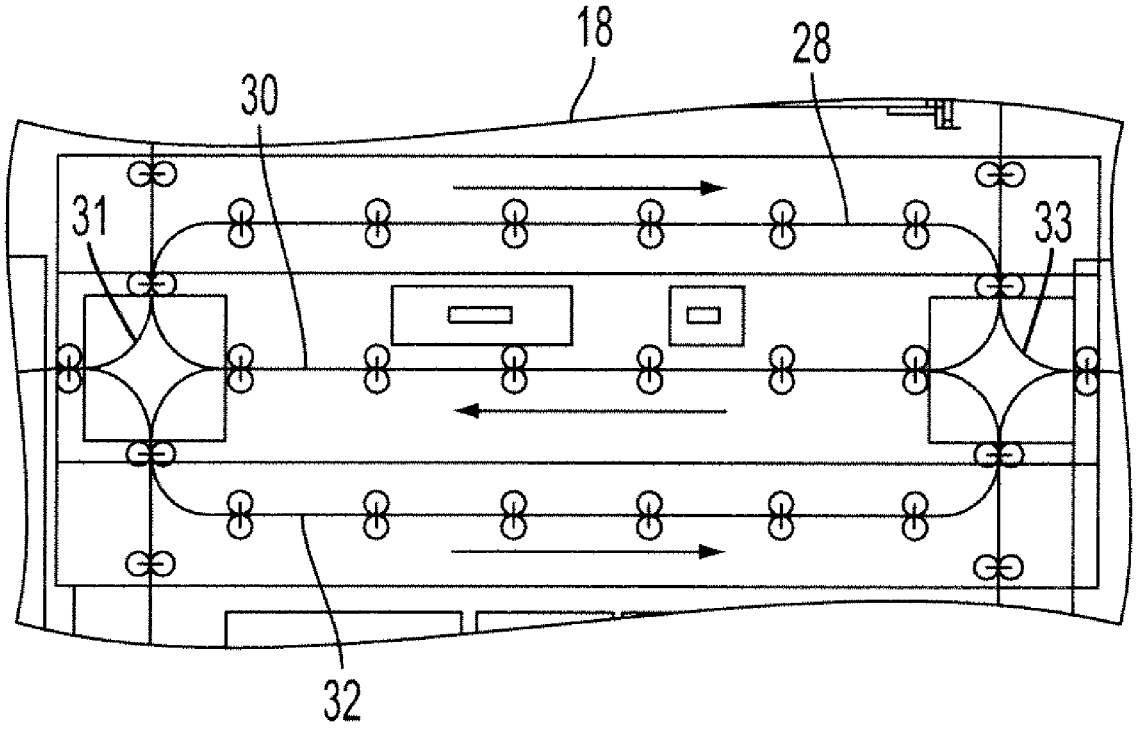
FIG. 3 illustrates a conventional printing system intersection module.
Figure 4:
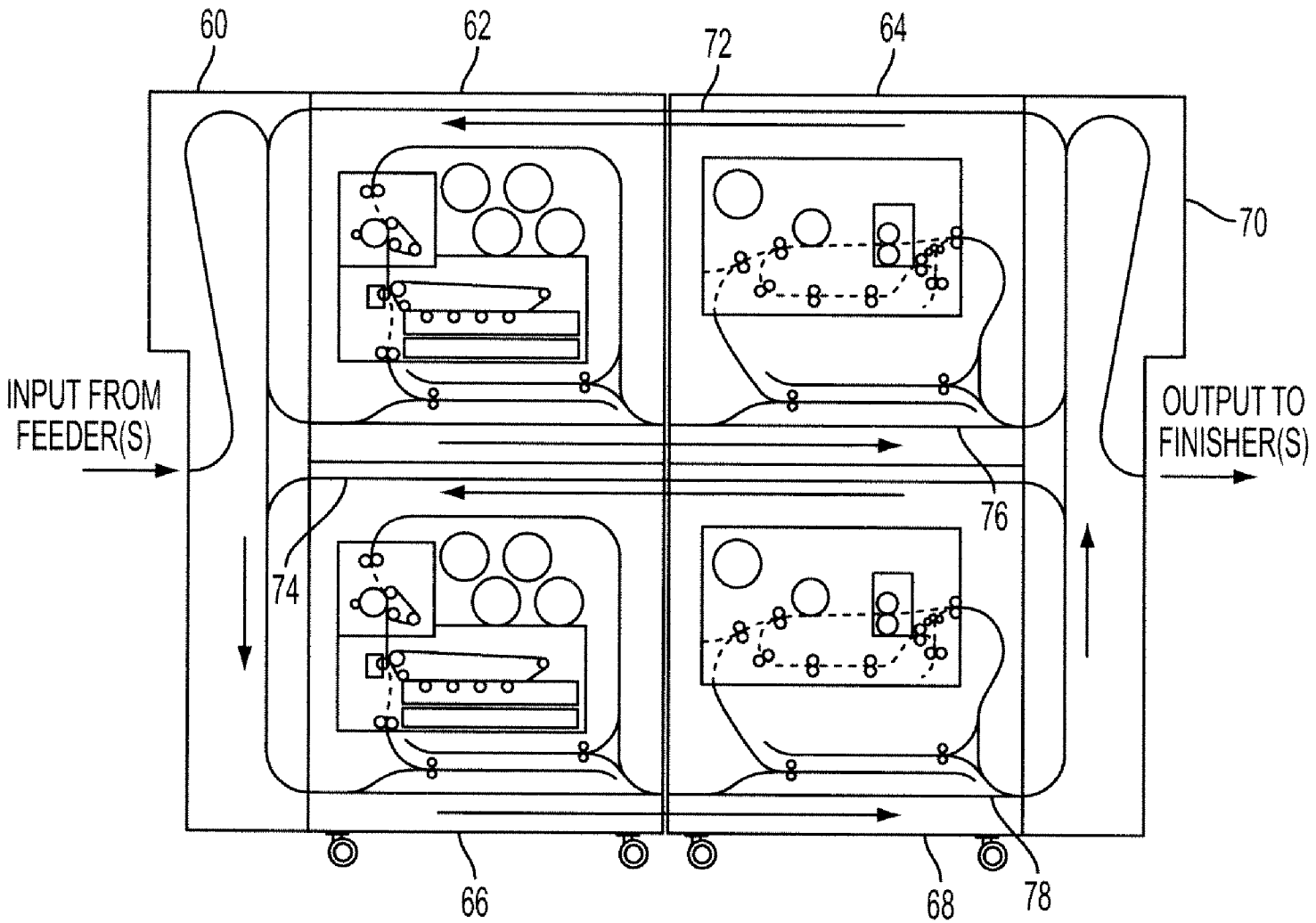
FIG. 4 illustrates another conventional four IME printing system.
Figure 5:
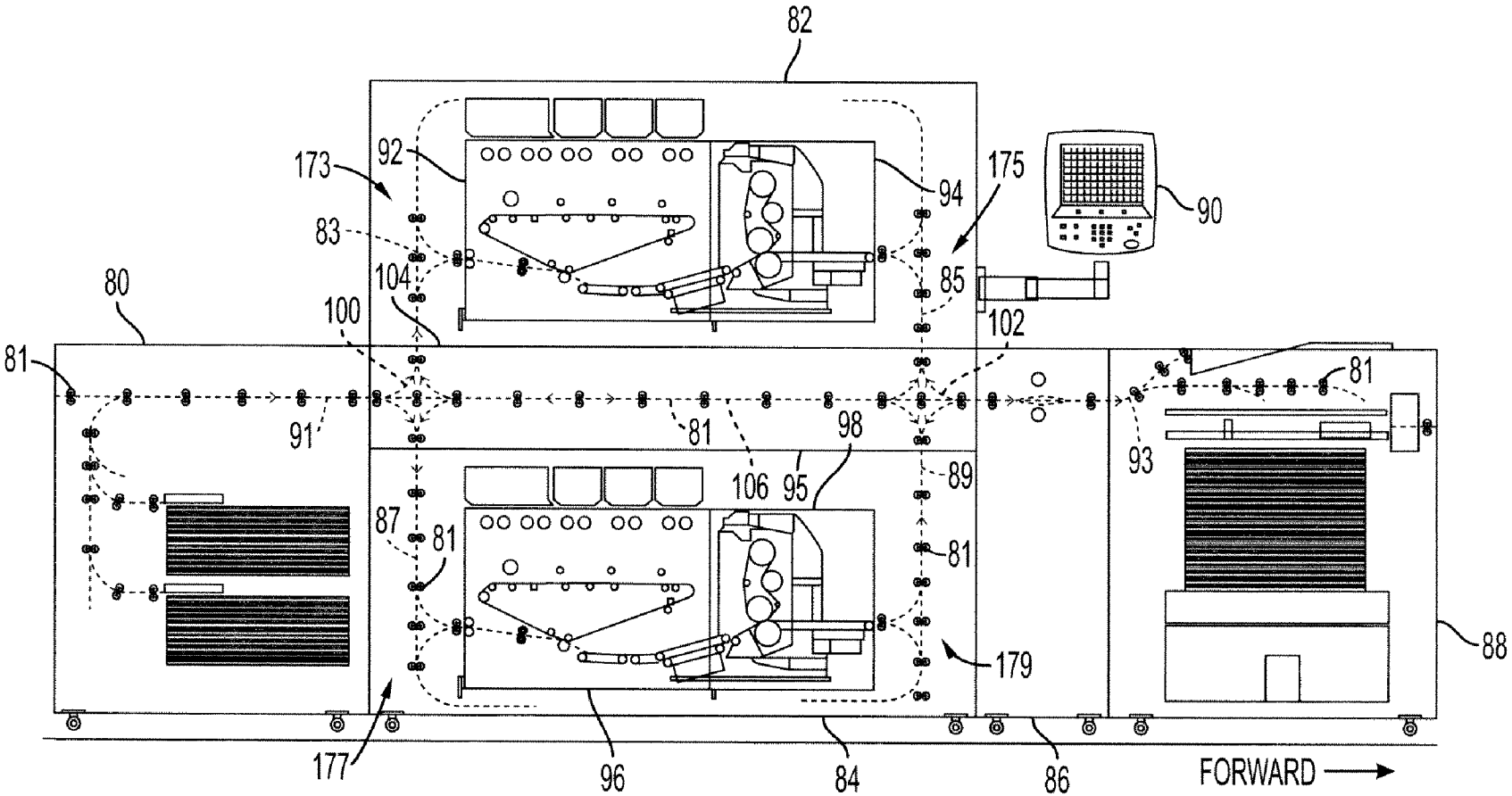
FIG. 5 illustrates an exemplary embodiment of a vertically integrated printing system including two IMEs according to this disclosure.

With reference to FIG. 5, illustrated is an exemplary embodiment of a printing system according to this disclosure which includes two IMEs.

The printing system includes a sheet feeder module 80, an upper printing module 82, a lower printing module 84, an interface module 86, a sheet stacker module 88, a user interface 90 and an intersection transport module 104. The upper printing module 82 includes an input inverter 173, an upper IME 92, an upper fuser 94 and an output inverter 175. The lower printing module 84 includes an input inverter 177, a lower IME 96, a lower fuser 98 and an output inverter 179. The intersection transport module 104 includes a sheet input intersection transport 100, a sheet output intersection transport 102 and a horizontal bidirectional transport 106 operatively connected between the input and output intersection transports.

To facilitate directing media sheets within the printing system, transport nips 81 are integrated within the printing system. Notably, only five transport nips 81 have been identified in FIG. 5, however, other transport nips are identified with similar schematical representations.

Substantially, the printing system illustrated in FIG. 5 includes one pair of printing modules 82 and 84 which are vertically aligned, wherein the respective input paths 83 and 87, and respective output paths 85 and 89, are substantially vertically aligned. In addition, the transport module 104 includes an input intersection transport 100 horizontally aligned with the output path of the sheet feeder module 80, vertically aligned with the input paths 83 and 87 of the printing modules 82 and 84, respectively, and horizontally aligned with the single horizontal transport 106. The transport module 104 also includes an output intersection transport 102 horizontally aligned with the input path of the interface module 86, vertically aligned with the output paths 85 and 89 of the printing modules 82 and 84, respectively, and horizontally aligned with the single horizontal transport 106.

With regard to the input intersection transport 100, operatively connected transport nips and gates provide a means for directing media sheets from the output path 91 of the sheet feeder module 80 to the upper printing module input path 83, the horizontal transport 106 and the lower printing module input path 87.

With regard to the output intersection transport 102, operatively connected transport nips and gates provide a means for directing media sheets from the horizontal transport 106, the upper printing module output path 85 and the lower printing module output path 89 to the interface module 86 which is operatively connected to the input path 93 of the output sheet stacker module 88.

With regard to the horizontal transport 106, the above discussion pertaining to the input intersection transport 100 and output intersection transport 102 is directed to a single direction horizontal transport operating in the forward direction. However, it is within the scope of this disclosure to include a single bidirectional horizontal transport as illustrated in FIG. 5.

With the added functionality of a bidirectional horizontal transport 106, the input intersection transport 100 is further adapted by means of operatively connected transport nips and gates to provide for directing media sheets from the horizontal transport 106 operating in reverse to the upper printing module input path 83 and the lower printing module input path 87. In addition, the output intersection transport 102 is further adapted by means of operatively connected transport nips and gates to provide for directing media sheets from the upper printing module output path 85 and lower printing module output path 87 to the bidirectional horizontal transport operating in reverse.

Figure 6:
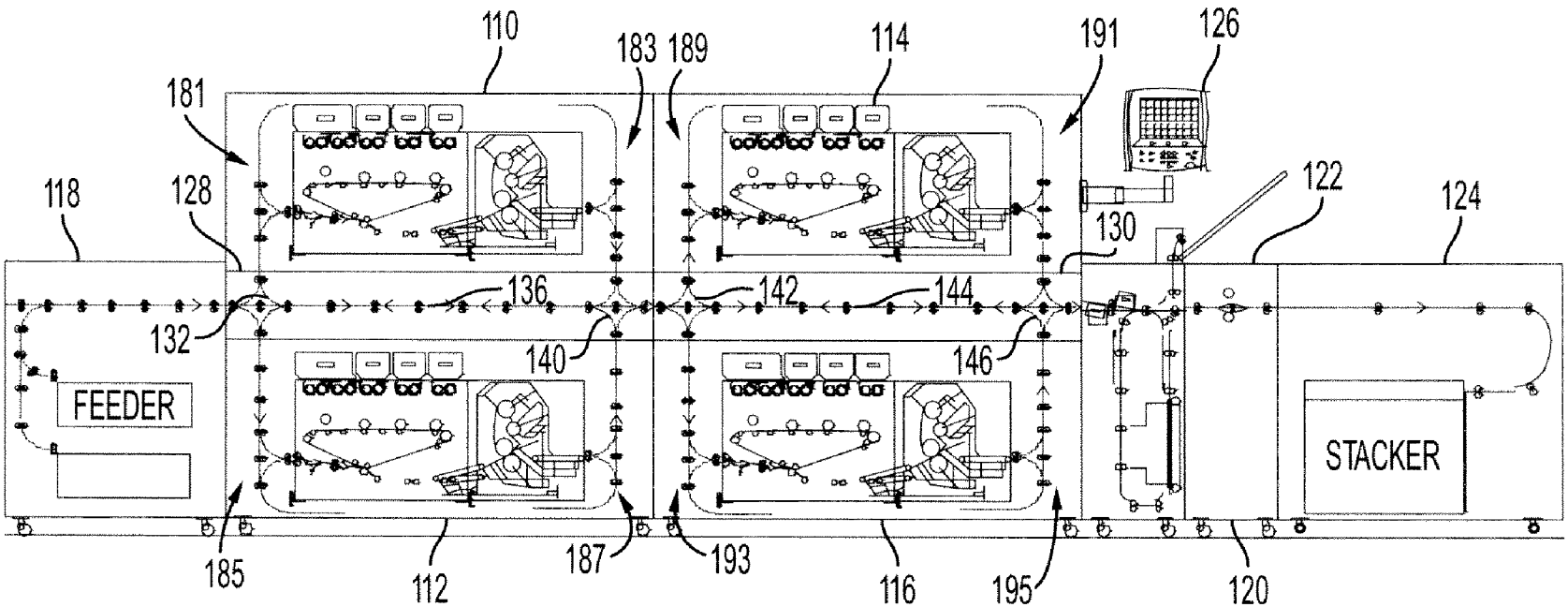
FIG. 6 illustrates another exemplary embodiment of a vertically integrated printing system including four IMEs according to this disclosure.

With reference to FIG. 6, illustrated is another exemplary embodiment of a printing system according to this disclosure which includes four IMEs. The printing system includes a sheet feeder module 118, a first upper printing module 110, a second upper printing module 114, a first lower printing module 112, a second lower printing module 116, a user terminal 126, a sheet ejector module 120, an interface module 122, a sheet stacker module 124, a first intersection transport module 128 and a second intersection transport module 130. Each of the printing modules 110, 112, 114 and 116 includes a respective input inverter, i.e., 181, 185, 189 and 193, respectively, an IME, a fuser and an output inverter, i.e., 183, 187, 191 and 195 respectively. The first intersection transport module 128 includes a sheet input intersection transport 132, a sheet output intersection transport 140 and a bidirectional transport 136 operatively connected between the input and output intersection transports associated with the first intersection transport module 128. The second intersection transport module 130 includes a sheet input intersection transport 142, a sheet output intersection transport 146 and a bidirectional transport 144 operatively connected between the input and output intersection transports associated with the second intersection transport module 130.

To facilitate directing media sheets within the printing system, transport nips are integrated within the printing system as described with reference to FIG. 5.

Substantially, the printing system illustrated in FIG. 6 includes two pairs of printing modules. A first pair of printing modules includes upper printing module 110 and lower printing module 112. A second pair of printing modules includes upper printing module 114 and lower printing module 116. Substantially, each pair of printing modules and respective transport modules operates as described with reference to FIG. 5 and will not be repeated here. However, it should be understood output intersection transport 140 is associated with the first pair of printing modules 110 and 112 and directs media sheets to the input intersection transport 142 associated with the second pair of printing modules 114 and 116. Moreover, the input intersection transport 142 associated with the second pair of printing modules 114 and 116 receives media sheets from the output intersection transport 140 associated with the first pair of printing modules 110 and 112. Furthermore, the output intersection transport 146 associated with the second printing module pair 114 and 116 directs media sheets to a sheet ejector module 120 which is operatively connected to an interface module 122.

It is to be understood, the printing systems illustrated in FIGS. 5 and 6, and described with reference to FIGS. 5 and 6 are only exemplary embodiments of printing systems which can include intersection transports as disclosed herein. Other variations of printing systems which include intersection transports are within the scope of this disclosure.

Figure 7:
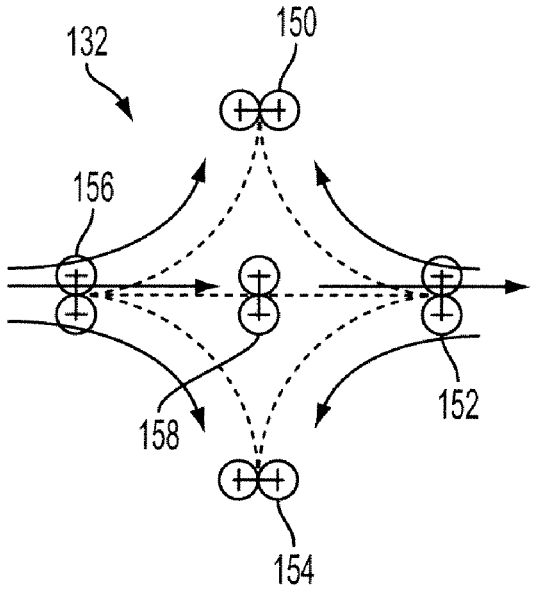
FIG. 7 illustrates an exemplary embodiment of an input intersection transport according to this disclosure.
Figure 8:
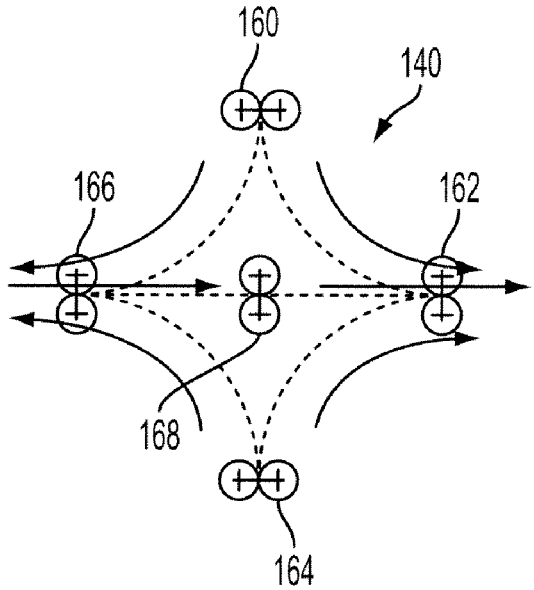
FIG. 8 illustrates an exemplary embodiment of an output intersection transport according to this disclosure.

With reference to FIG. 7 and FIG. 8, illustrated are exemplary embodiments of an input intersection transport and output intersection transport, respectively, associated with the intersection transport modules shown in FIGS. 5 and 6.

FIG. 7 illustrates a pinch nip arrangement to provide an input intersection transport as indicted by reference characters 100, 132 and 142. The illustrated arrows indicate the plurality of media sheet travel directions associated with the input intersection transport. FIG. 8 illustrates a pinch nip arrangement to provide an output intersection transport as indicated by reference characters 102, 140 and 146. The illustrated arrows indicate the plurality of media sheet travel directions associated with the output intersection transport. The input intersection transport pinch nip arrangement illustrated in FIG. 7 includes an upper output pinch nip 150, a lower output pinch nip 154, an input pinch nip 156, a bidirectional input/output pinch nip 152 and a center pinch nip 158.

The output intersection transport pinch nip arrangement illustrated in FIG. 8 includes an upper input pinch nip 160, a lower input pinch nip 164, an output pinch nip 162, a bidirectional input/output pinch nip 166 and a center pinch nip 168.

According to one exemplary embodiment of the pinch nips, which is well known in the art, an upper and lower arrangement is used where the upper roll is driven in either a forward or reverse direction to facilitate movement of a media sheet. The lower roll associated with the pinch nip is passive and acts as a backing roll to control the pinching or friction effect directed to a media sheet driven tangentially between the upper and lower rolls.

Figure 9:
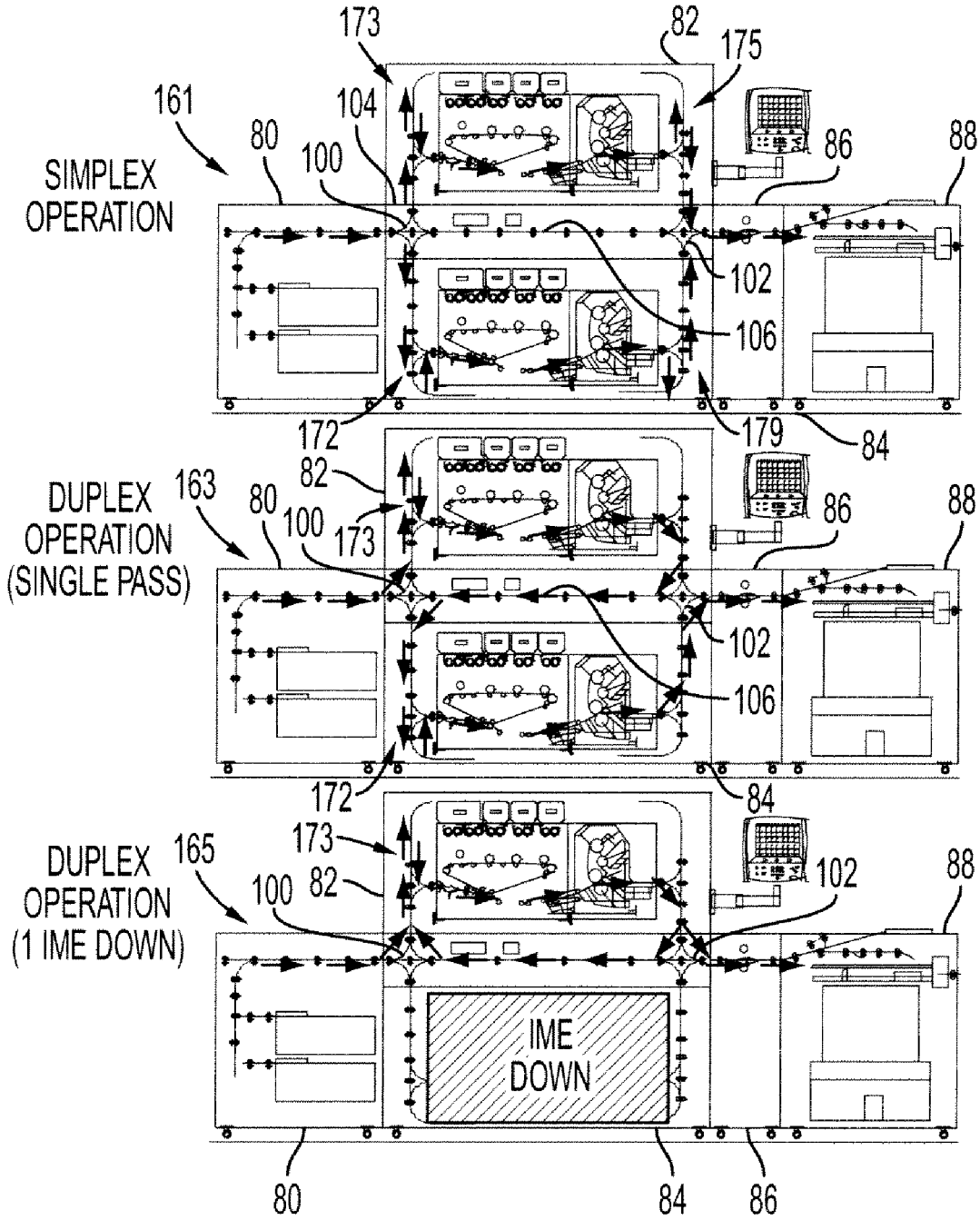
FIG. 9 illustrates an exemplary operation of the printing system shown in FIG. 5, for simplex operation, duplex operation (single pass) and duplex operation (one IME inoperative) according to this disclosure.

With reference to FIG. 9, illustrated are exemplary print modes associated with a two IME printing system as illustrated in FIG. 5; the printing modes including a simplex printing operation 161, a single pass duplex printing operation 163, and a multiple pass duplex printing operation 165 where one IME is inoperative. The arrows indicate the direction and path a media sheet travels in each respective print mode.

With regard to the simplex mode of operation 161, a print job is executed with each printing module operating in a simplex mode, where each printing module, 82 and 84, prints on one side of a media sheet originally transported from the sheet feeder module 80. The simplex printed media sheets are subsequently merged by the output intersection transport 162 and directed through the interface module 86 to the sheet stacker module 88.

In operation, alternating media sheets from the sheet feeder module 80 are directed to the upper printing module 82 and lower printing module 84 by the input intersection transport 100. After the respective printing modules invert, mark, fuse, and invert again the media sheets, the output intersection transport merges the printed media sheets by alternating the output intersection transport input path between the upper printing module output path and the lower printing module output path. As previously described, the output intersection transport directs media sheets from the upper and lower printing module output paths to a common output path which, in this case, is operatively connected to the interface module 86.

With regard to the duplex mode of operation 163, a duplex print job is executed with each printing module operating in a single pass duplex mode, where each printing module 82 and 84 prints on an opposite side of a media sheet to produce a two-sided marked media sheet.

In operation, media sheets are initially transported from the sheet feeder module 80 to the input intersection transport 100, where the input intersection transport 100 directs the received media sheet to the upper printing module 82 for inversion, marking on side one, fusing and transport to the output intersection transport 102. Next, the output intersection transport 102 directs the marked media sheet to the horizontal transport 106 operating in reverse to the input intersection transport 100, where the input intersection transport 100 directs the received marked media sheet to the lower printing module 84 for inversion, marking on side two, fusing and transport to the output intersection transport 102. Finally, the output intersection transport 102 directs the two-sided printed media sheet to the interface module 86 which subsequently directs the two-sided printed media sheet to the sheet stacker module 88.

With regard to the duplex mode of operation 165 with the lower printing module 184 inactivated, a duplex print job is executed with the upper printing module 82 operating in a double-pass duplex print mode, where the upper printing module 82 initially prints on a first side of a media sheet, then subsequently prints on the opposite or second side of the media sheet.

In operation, media sheets are initially transported from the sheet feeder module 80 to the input intersection transport 100, where the input intersection transport 100 directs the received media sheet to the upper printing module 82 for inversion, marking on side one, fusing and transport to the output intersection transport 102. Next, the output intersection transport 102 directs the marked media sheet to the horizontal transport 100, where the input intersection transport 100 directs the marked media sheet to the upper printing module 82 for inversion, marking on side two, fusing and transport to the output intersection transport 102. Finally, the output intersection transport 102 directs the two-sided printed media sheet to the interface module 86 which subsequently directs the two-sided printed media sheet to the interface module 86 which subsequently directs the two-sided printed media sheet to the sheet stacker module 88.

Figure 10:
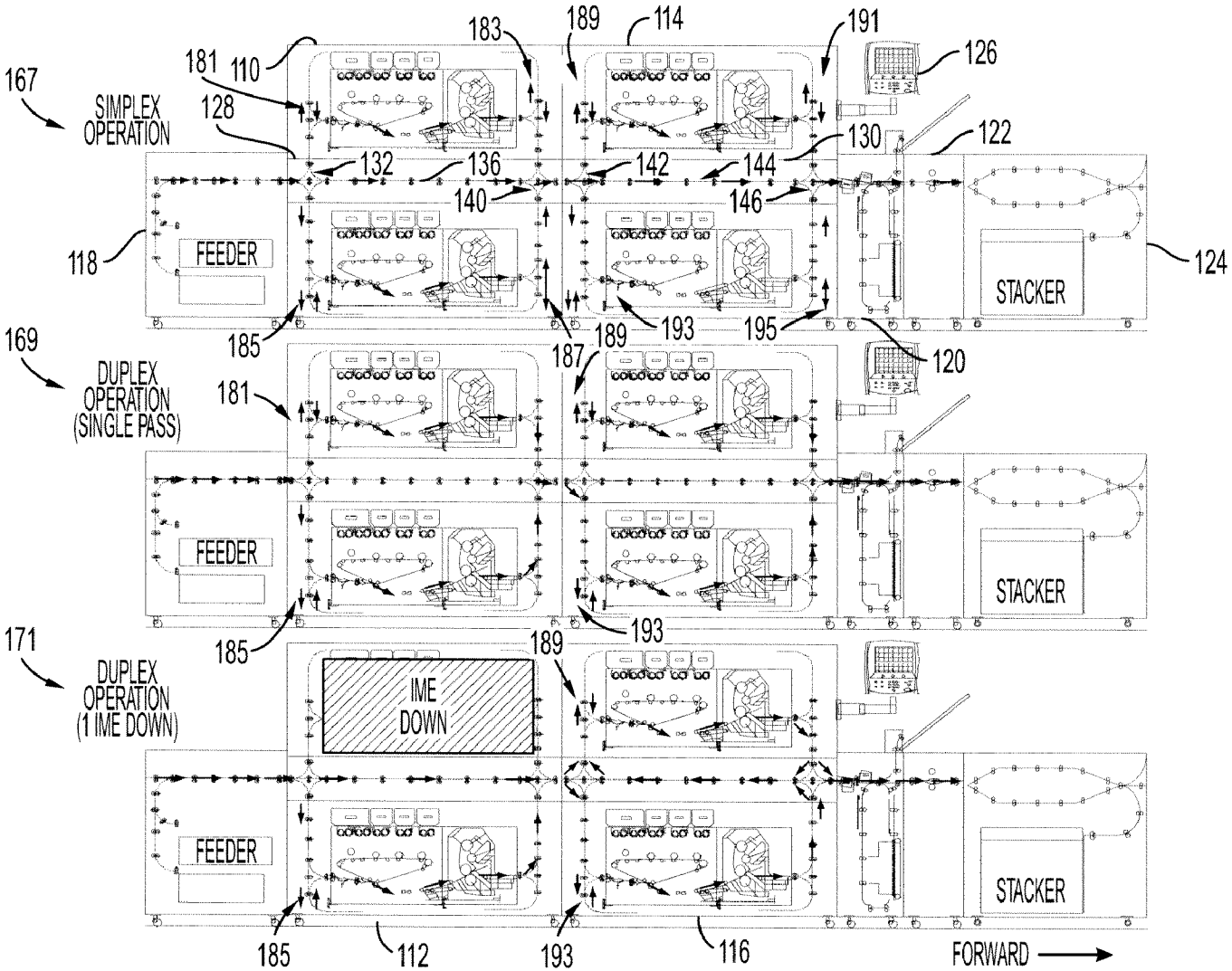
FIG. 10 illustrates an exemplary operation of the printing system shown in FIG. 6, for simplex operation, duplex operation (single pass) and duplex operation (one IME inoperative) according to this disclosure.

With reference to FIG. 10, illustrated are exemplary print modes associated with a four IME printing system as illustrated in FIG. 6; the printing modes include a simplex printing operation 167, a single pass duplex printing operation 169 and a multiple pass duplex printing operation 171 where one IME is inoperative. The arrows indicate the direction and path a media sheet travels in each respective print mode.

With regard to the simplex mode of operation 167, a print job is executed with three printing modules operating in a simplex mode, where each printing module, 110, 112 and 114, prints on one side of a media sheet originally transported from the sheet feeder module 118. The simplex printed media sheets are subsequently merged by the output intersection transports 140 and 146 and directed to the sheet stacker module 124. It is to be appreciated that other simplex printing modes are equally possible using a greater or lesser number of printing modules.

In operation, a series of three media sheets are directed from the sheet feeder module 118 to the first input intersection transport 132, where the input intersection transport 132 directs the first media sheet to the first upper printing module 110, a second media sheet to the first lower printing module 112, and the third media sheet to the first horizontal transport 136 operating in the forward direction, which directs the third media sheet to the first output intersection transport 140 for direction to the second intersection transport which directs the third media sheet to the second upper printing module 114.

After printing modules 110, 112 and 114, invert, mark, fuse and invert again the first, second and third media sheets, respectively, the first output intersection transport 140 merges the first and second printed media sheets and directs these media sheets to the second input intersection transport for transport to the second horizontal transport 144 operating in the forward direction. The second output intersection receives the third printed media sheet from the second upper printing module 114, the first printed media sheet from the second horizontal highway 144, and the second printed media sheet from the second horizontal highway, where the output intersection transport merges and directs the printed media sheets to the sheet stacker module 124 by way of the sheet ejector module 120 and interface module 122.

With regard to the duplex mode of operation 169 (single pass), a printing job is executed with four printing modules, where the first pair of printing modules, 110 and 112, prints on side one of a first and second media sheet. Subsequently, a second pair of printing modules 114 and 116 prints on side two of the first and second media sheets. The completed two-sided printed media is merged and directed by the second output intersection transport 146 to the sheet stacker module by way of the sheet ejector module 120 and interface module 122.

In operation, a series of two media sheets are directed from the sheet feeder module 118 to the first input intersection transport 132, where the input intersection transport 132 directs the first and second media sheets to the first upper printing module 110 and first lower printing module 112, respectively. After the first upper and lower printing modules invert, mark and fuse the respective media sheets, the first output intersection transport 140 merges the respective printed media sheets and directs the first and second one-sided printed media sheets to the second input intersection transport 142. The second input intersection transport directs the first one-sided printed media sheet to the second upper printing module 114 and the second one-sided printed media sheet to the second lower printing module 116.

After the second upper and lower printing modules, 114 and 116, invert, mark and fuse the respective one-sided printed media sheets, the two-sided printed media sheets are received by the second output intersection transport 146, where the two-sided printed media sheets are merged and directed to the sheet stacker module 124 by way of the sheet ejector module 120 and interface module 122.

With regard to the duplex mode of operation, where one printing module 110 is inactive, and three print modules, 112, 114 and 116, are active, the first lower printing module 112 and the second lower printing module 116 print on the first side and on the second side of a first media sheet, respectively.

The second upper printing module 114 subsequently prints on the first side and on the second side of the second media sheet and the second output intersection transport 146 merges and directs the two-sided printed media sheets to the sheet stacker module 124 by way of the sheet ejector module 120 and interface module 122.

In operation, a series of two media sheets are directed from the sheet feeder module 118 to the first input intersection transport 132, where the input intersection transport 132 directs the first media sheet to the first lower printing module 112 and directs the second media sheet to the first horizontal transport 136 operating in the forward direction. The first horizontal transport directs the second media sheet to the first output intersection transport 140 which directs the second media sheet to the second intersection transport for direction to the second upper printing module 114.

After the second upper printing module 114 inverts, marks and fuses the first side of the second media sheet, the second output intersection transport receives the one-sided printed media sheet and directs the second media sheet to the horizontal transport 144 operating in reverse which transports the second media sheet to the second intersection transport 142. The second intersection transport directs the second media sheet to the second upper printing module 114 for inversion, marking the second side and fusing.

The second output intersection transport directs the first and second two-sided printed media from the second upper printing module to the sheet stacker module 124 by way of the sheet ejector module 120 and interface module 122.

After the first lower printing module 112 inverts, marks and fuses the first media sheet, the first output intersection transport receives the first one-sided printed media sheet and directs the first media sheet to the second input intersection transport which directs the first media sheet to the second lower printing module 116 for inversion, marking the second side and fusing.

Figure 11:
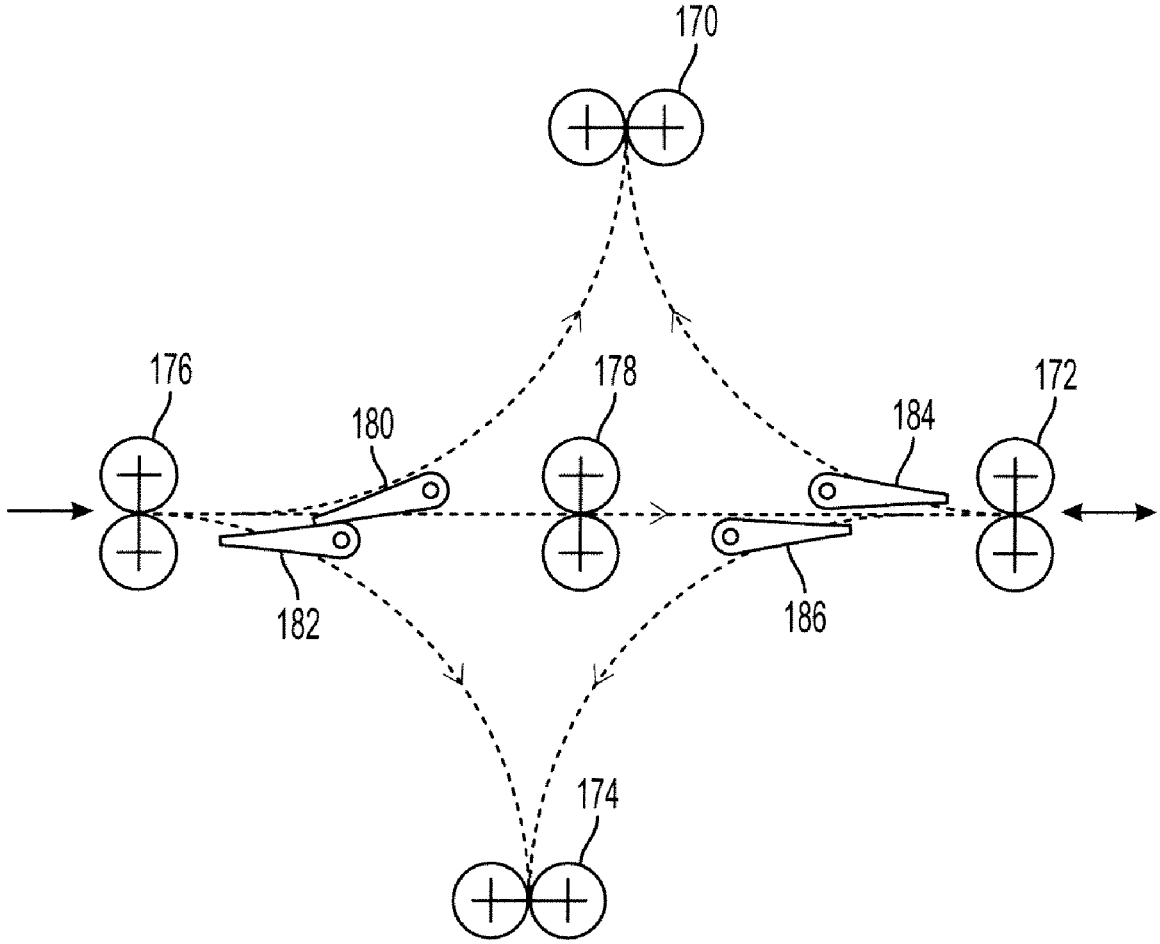
FIG. 11 illustrates an exemplary embodiment of a gate configuration according to this disclosure.

With reference to FIG. 11, illustrated is an exemplary embodiment of a media sheet input intersection transport for use in an intersection transport module as disclosed in FIGS. 5 and 6. The input intersection transport includes an upper output pinch nip 170, a lower output pinch nip 174, an input pinch nip 176, a bidirectional input/output pinch nip 172 and a center pinch nip 178.

To provide selective directional control of a media sheet transported from input pinch nip 176, a staggered two-way input gate pair arrangement includes a top guide 180 and a bottom guide 182. To provide selective directional control of a media sheet transported from the center pinch nip 178 to the bidirectional input/output pinch nip 172, a media sheet transported from the bidirectional input/output pinch nip 172 to the upper output pinch nip 170, and a media sheet transported from the bidirectional input/output pinch nip 172 to the lower output pinch nip 174, a staggered two-way input/output gate pair arrangement includes an upper guide 184 and a lower guide 186.

Figure 12:
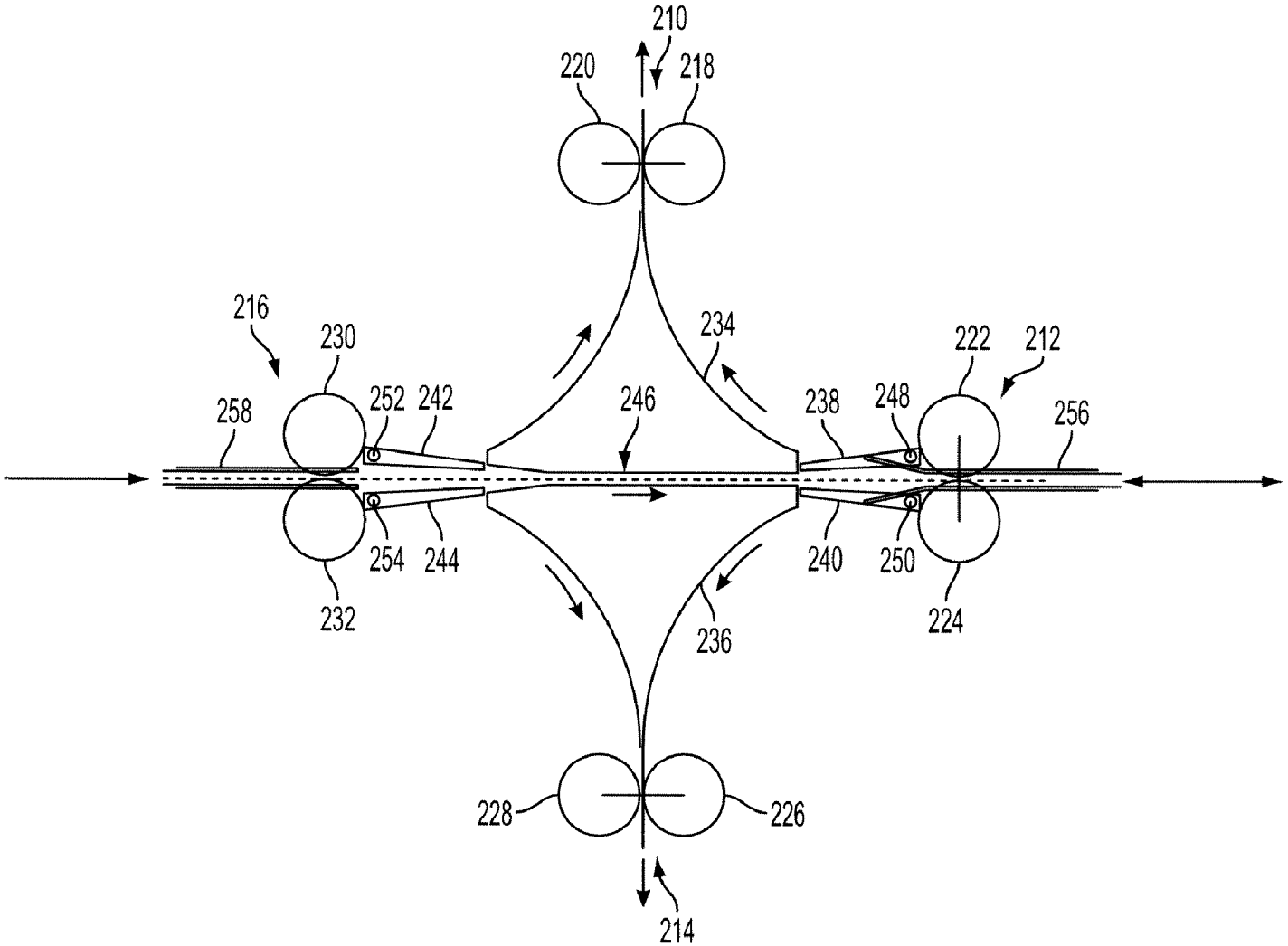
FIG. 12 illustrates an exemplary embodiment of an input intersection transport including a three-way gate arrangement according to this disclosure.

With reference to FIG. 12, illustrated is another exemplary embodiment of a media sheet input intersection transport for use in an intersection transport module as disclosed in FIGS. 5 and 6. The media sheet input intersection transport includes an upper output pinch nip 210, a lower output pinch nip 214, and input pinch nip 216, a bidirectional input/output pinch nip 212, an upper inner guide structure 234, a lower inner guide structure 236, an inner sheet guide 246, an input baffle pair 258 and an input/output baffle 256 suitable for bidirectional sheet transport.

To provide selective directional control of a media sheet transported from the input pinch nip 216, a three-way input gate arrangement includes an upper pivoting guide 242 and a lower pivoting guide 244. To provide selective directional control of a media sheet transported from the inner sheet guide 246 to the bidirectional input/output pinch nip 212, a media sheet transported from the bidirectional input/output pinch nip 212 to the upper output pinch nip 210, and a media sheet transported from the bidirectional input/output pinch nip 212 to the lower output pinch nip 214, a three-way bidirectional input/output gate arrangement includes an upper pivoting guide 238 and a lower pivoting guide 240.

The input pinch nip 216 includes rollers 230 and 232; the upper output pinch nip 210 includes rollers 218 and 200; the lower output pinch nip 214 includes rollers 226 and 228; and the bidirectional input/output pinch nip 212 includes rollers 222 and 224.

Upper and lower pivoting guides 242, 244, 238, 240 preferably are constructed to provide guidance along the entire leading edge of each sheet. The guides are preferably constructed using lightweight, durable material which could include plated sheet steel, anodized aluminum, or reinforced thermoplastic. Baffle pairs 256, 258 and inner guide structures 234 and 236 are preferably constructed to support and guide along the entire leading edge of each sheet and are preferably constructed using a dimensionally stable, durable material such as plated sheet steel or reinforced thermoplastic.

Gate guides 242, 244, 238 and 240 are operatively connected to a pivoting structure at points 252, 254, 248 and 250, respectively, to enable pivoting of the gates to three distinct positions.

Figure 13:
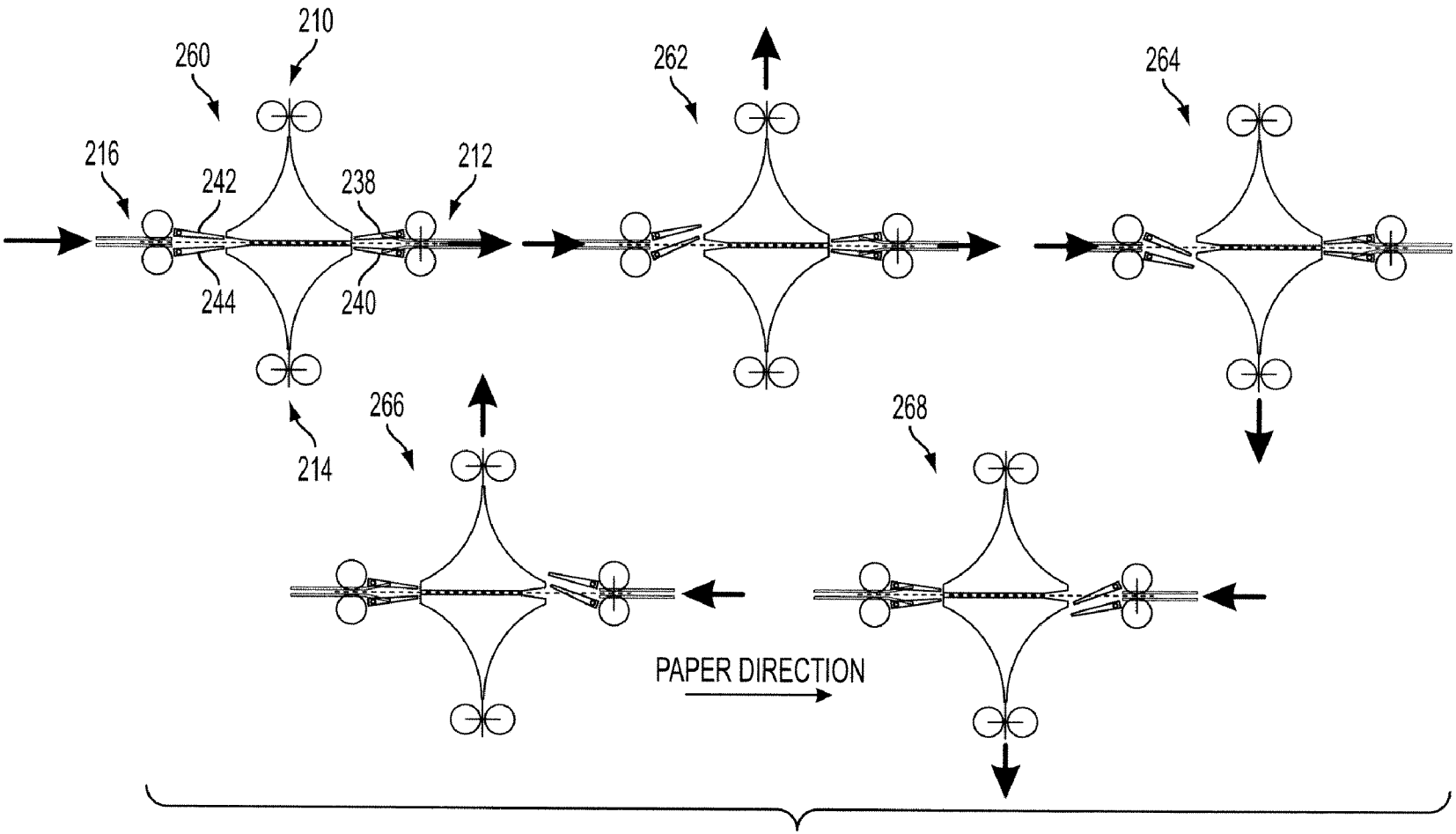
FIG. 13 illustrates the operational status of the input intersection transport illustrated in FIG. 12.

With reference to FIG. 13, illustrated are the operational states of a three-way gate structure as illustrated in FIG. 12.

Diagram 260 illustrates a forward-pass-through state, diagram 262 illustrates a forward-up state, diagram 264 illustrates a forward-down state, diagram 266 illustrates a reverse-up state, and diagram 268 illustrates a reverse-down state.

Figure 14:
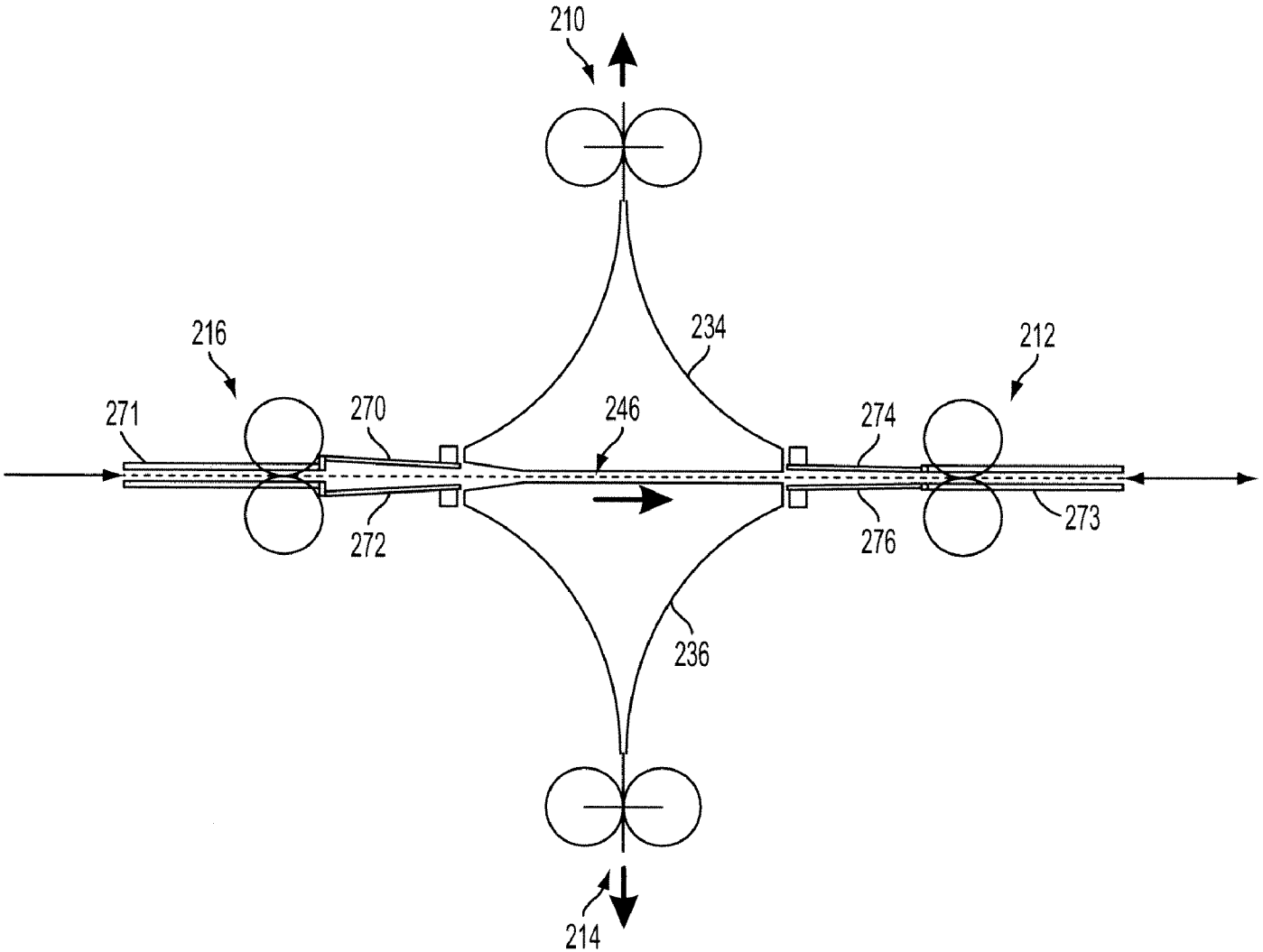
FIG. 14 illustrates another exemplary embodiment of an input intersection transport including a three-way gate arrangement according to this disclosure.

With reference to FIG. 14, illustrated is another exemplary embodiment of a media sheet input intersection transport for use in an intersection transport module as disclosed in FIGS. 5 and 6. The media sheet input intersection transport includes an upper output pinch nip 210, an input pinch nip 216, a lower output pinch nip 214, a bidirectional input/output pinch nip 212, an upper inner guide structure 234, a lower inner guide structure 236 and an inner sheet guide 246 as described with reference to FIG. 12.

To provide selective directional control of a media sheet transported from the input pinch nip 216, a three-way input gate arrangement includes an upper flexible guide 270 and a lower flexible guide 272. To provide selective directional control of a media sheet transported from the inner sheet guide 246 to the bidirectional input/output pinch nip 212, a media sheet transported from the bidirectional input/output pinch nip 212 to the upper output pinch nip 210 and a media sheet transported from the bidirectional input/output pinch nip 212 to the lower output pinch nip 214, a three-way bidirectional gate arrangement includes an upper flexible gate 274 and a lower flexible gate 276.

Input baffle pair 271 provides additional guidance of a media sheet to the input nip 216. The leftmost ends of flexible guides 270 and 272 are rigidly attached to input baffle pair 271. A bidirectional input/output baffle pair 273 provides additional guidance of a media sheet to and from the bidirectional input/output nip 212. The rightmost ends of flexible guides 274 and 276 are rigidly attached to bidirectional input/output baffle pair 273. Upper and lower flexible guides 270, 272, 274, 276 preferably are constructed to provide guidance along the entire leading edge of each sheet. The guides are preferably constructed using a material with excellent fatigue strength such as sheet spring steel.

Figure 15:
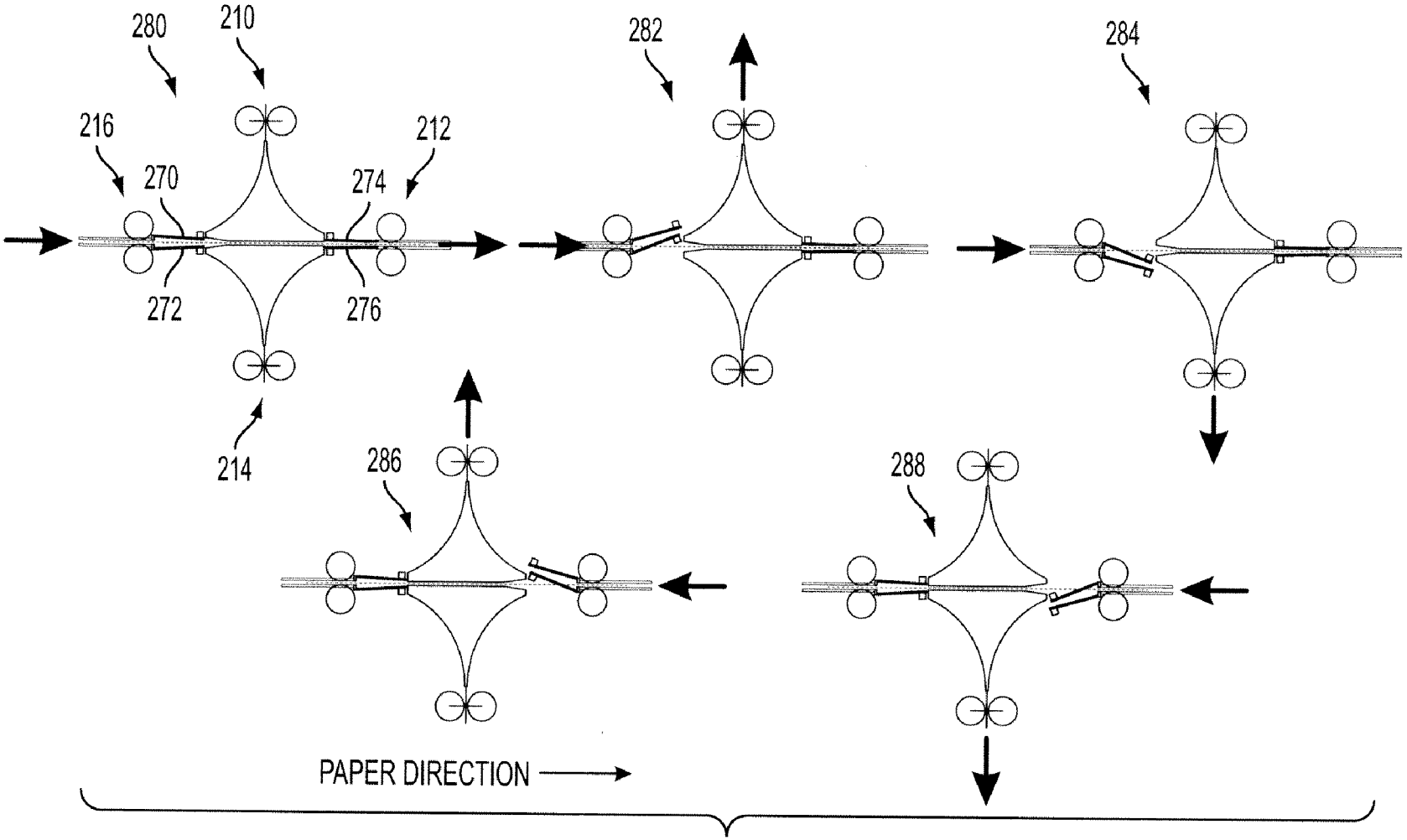
FIG. 15 illustrates the operation states of the input intersection transport illustrated in FIG. 14.

With reference to FIG. 15, illustrated are the operation states of an input intersection transport as illustrated in FIG. 14.

Diagram 280 illustrates a forward-pass-through state, diagram 282 illustrates a forward-up state, diagram 284 illustrates a forward-down state, diagram 286 illustrates a reverse-up state, and diagram 288 illustrates a reverse-down state.

Figure 16:
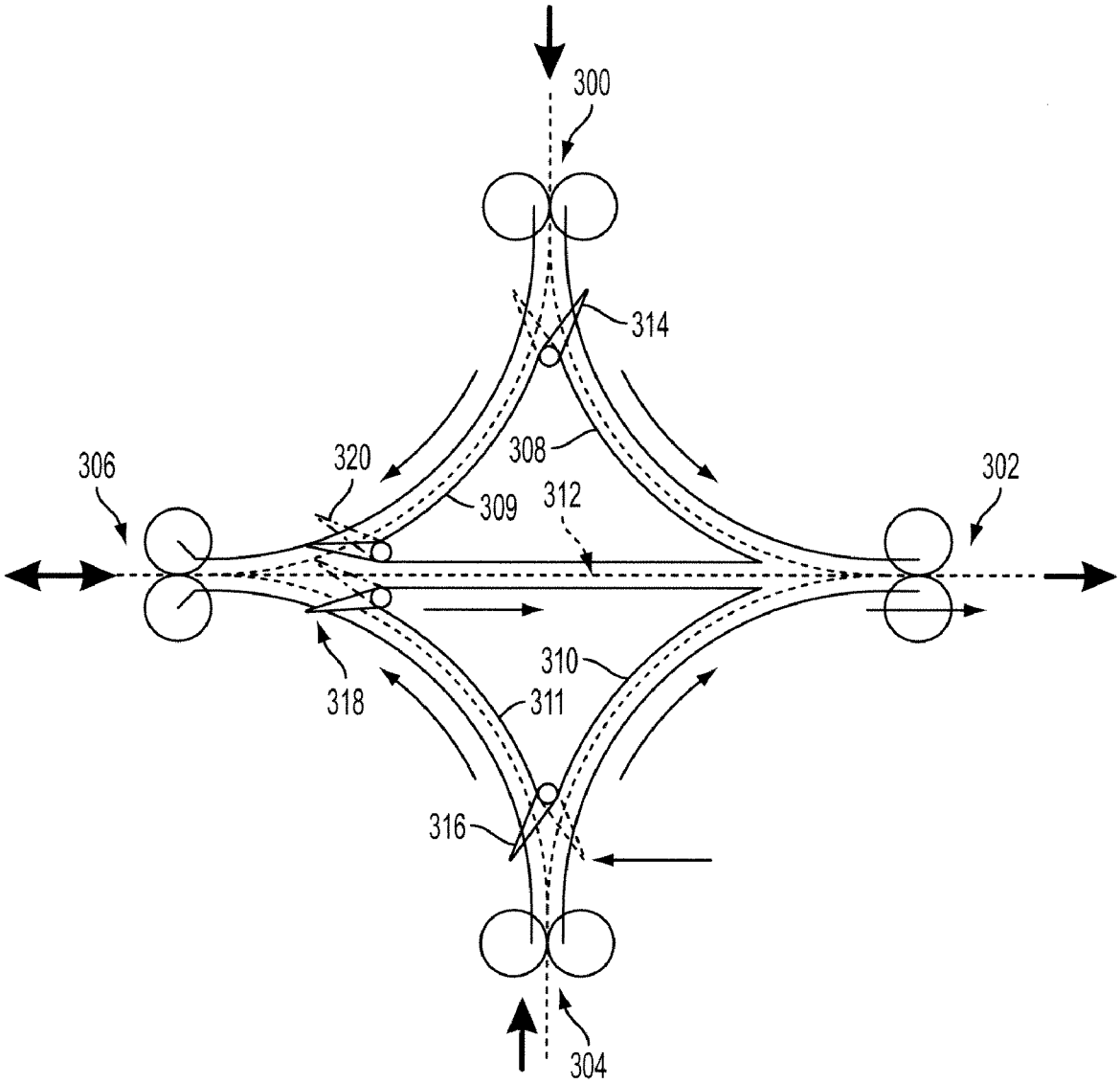
FIG. 16 illustrates an exemplary embodiment of an output intersection transport according to this disclosure.

With reference to FIG. 16, illustrated is an exemplary embodiment of an output intersection transport for use in an intersection transport module as disclosed in FIGS. 5 and 6. The output intersection transport includes an upper input pinch nip 300, an output pinch nip 302, a lower input pinch nip 304, a bidirectional input/output pinch nip 306, upper sheet guides 308, 309, lower sheet guides 310, 311, and inner sheet guide 312.

To provide selective directional control of a media sheet transported from the bidirectional input/output pinch nip 306 to the output pinch nip 302, a media sheet transported from the upper input pinch nip 300 to the bidirectional input/output pinch nip 306, and a media sheet transported from the lower input pinch nip 304 to the bidirectional input/output pinch nip 306, a two-way bidirectional gate pair arrangement includes an upper pivoting guide 320 and a lower pivoting guide 318.

To provide selective directional control of a media sheet transported from the top input pinch nip 300 to the bidirectional input/output pinch nip 306, and from the upper pinch nip 300 to the output pinch nip 302, a two-way gate arrangement includes pivoting guide 314.

To provide selective directional control of a media sheet transported from the lower input pinch nip 304 to the bidirectional input/output pinch nip 316, and to the output pinch nip 302, a two-way gate arrangement includes pivoting guide 316.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

one or more pairs of marking engines, each pair of marking engines comprising two substantially vertically aligned marking engines, wherein the respective input and output oaths associated with the substantially vertically aligned marking engines are substantially vertically aligned, and each pair includes an upper marking engine and a lower marking engine;

an input and output intersection transport associated with each pair of marking engines and operatively connected to the respective upper and lower marking engine inputs and outputs; and a single horizontal transport operatively connected to the input and output intersection transports, and directing media in a forward direction from the input intersection transport to the output intersection transport, wherein the input intersection transport is adapted to accept input media sheets from a common input and direct the input media sheets to the upper marking engine, the horizontal transport and the lower marking engine, and the output intersection transport is adapted to direct media sheets from the upper marking engine, the horizontal transport and the lower marking engine to a common output; and wherein the horizontal transport is bidirectional and the output intersection transport is further adapted to direct media sheets from the upper marking engine and lower marking engine to the horizontal transport operating in reverse, and the input intersection transport is further adapted to direct media sheets to the upper marking engine and lower marking engine from the horizontal transport operating in reverse.

2. The printing system according to claim 1, wherein one or more pairs of substantially vertically aligned marking engines are configured to operate in a simplex mode, where media sheets are directed from the respective input intersection transport to the upper and lower marking engines, the media sheets are marked by the respective upper and lower marking engines, the marked media sheets from the upper and lower marking engines are directed to the respective output intersection transport, and the respective intersection transport merges the marked media sheets.

3. The printing system according to claim 1, wherein one or more pairs of substantially vertically aligned marking engines are configured to operate in a single pass duplex mode, where media sheets are directed from the respective input intersection transport to a first respective marking engine, the media sheets are marked on a first side by the respective marking engine, the marked media sheets are directed to the respective output intersection transport, the output intersection transport directs the marked media sheets to the respective horizontal transport operating in reverse, the horizontal transport directs the marked media sheets to the respective input intersection transport, the input intersection transport directs the marked media sheets to the second respective marking engine for marking on the second side, the marked media sheets are directed to the respective output intersection transport, and the output intersection transport directs the marked media sheets to a respective output.

4. The printing system according to claim 1, wherein two or more pairs of substantially vertically aligned marking engines are configured to operate in a single pass duplex mode, where media sheets are directed from the respective input intersection transport to a first respective marking engine, the media sheets are marked on a first side by the respective marking engine, the marked media sheets are directed to the respective output intersection transport, the output intersection transport directs the marked media sheets to the respective horizontal transport, the horizontal transport directs the marked media sheets to the respective input intersection transport, the input intersection transport directs the marked media sheets to the second respective marking engine for marking on the second side, the marked media sheets are directed to the respective output intersection transport, and the output intersection transport directs the marked media sheets to a respective output.

5. The printing system according to claim 1, wherein one or more pairs of substantially vertically aligned marking engines are configured to operate in a single marking engine duplex mode, where media sheets are directed from the respective input intersection transport to a respective marking engine, the media sheets are marked on a first side by the respective marking engine, the marked media sheets are directed to the respective output intersection transport, the output intersection transport directs the marked media sheets to the respective horizontal transport operating in reverse, the horizontal transport directs the marked media sheets to the respective input intersection transport, the input intersection transport directs the media sheets to the respective marking engine for marking on the second side of the media sheet, the marked media sheets are directed to the respective output intersection transport, and the output intersection transport directs the marked media sheets to a respective output.

6. The printing system according to claim 1, wherein the printing system is configured to operate in a combination of two or more modes associated with simplex sheet printing, single-pass duplex sheet printing and multiple-pass duplex sheet printing.

7. A printing system comprising:

one or more pairs of marking engines, each pair of marking engines comprising two substantially vertically aligned marking engines, wherein the respective input and output paths associated with the substantially vertically aligned marking engines are substantially vertically aligned, and each pair includes an upper marking engine and a lower marking engine;

an input and output intersection transport associated with each pair of marking engines and operatively connected to the respective upper and lower marking engine inputs and outputs; and a single horizontal transport operatively connected to the input and output intersection transports, and directing media in a forward direction from the input intersection transport to the output intersection transport, wherein the input intersection transport is adapted to accept input media sheets from a common input and direct the input media sheets to the upper marking engine, the horizontal transport and the lower marking engine, and the output intersection transport is adapted to direct media sheets from the upper marking engine, the horizontal transport and the lower marking engine to a common output; and wherein one or more input or output intersection transports comprise a sequential two-way gate pair configuration.

8. A printing system comprising:

one or more pairs of marking engines, each pair of marking engines comprising two substantially vertically aligned marking engines, wherein the respective input and output paths associated with the substantially vertically aligned marking engines are substantially vertically aligned, and each pair includes an upper marking engine and a lower marking engine;

an input and output intersection transport associated with each pair of marking engines and operatively connected to the respective upper and lower marking engine inputs and outputs; and a single horizontal transport operatively connected to the input and output intersection transports, and directing media in a forward direction from the input intersection transport to the output intersection transport, wherein the input intersection transport is adapted to accept input media sheets from a common input and direct the input media sheets to the upper marking engine, the horizontal transport and the lower marking engine, and the output intersection transport is adapted to direct media sheets from the upper marking engine, the horizontal transport and the lower marking engine to a common output; and wherein one or more input or output intersection transports comprise a three-way gate configuration.

9. A printing system comprising:

one or more pairs of marking engines, each pair of marking engines comprising two substantially vertically aligned marking engines, wherein the respective input and output paths associated with the substantially vertically aligned marking engines are substantially vertically aligned, and each pair includes an upper marking engine and a lower marking engine;

an input and output intersection transport associated with each pair of marking engines and operatively connected to the respective upper and lower marking engine inputs and outputs; and a single horizontal transport operatively connected to the input and output intersection transports, and directing media in a forward direction from the input intersection transport to the output intersection transport, wherein the input intersection transport is adapted to accept input media sheets from a common input and direct the input media sheets to the upper marking engine, the horizontal transport and the lower marking engine, and the output intersection transport is adapted to direct media sheets from the upper marking engine, the horizontal transport and the lower marking engine to a common output; and one or both of the intersection transports comprise:

an upper substantially triangular shaped structure; and a lower substantially triangular shaped structure, wherein a first facet associated with the upper and lower substantially triangular shaped structures are aligned to provide an inner guide for directing a media sheet.

10. The printing system according to claim 9, wherein a second and third facet associated with the upper substantially triangular structure directs media sheets upwardly from two different directions to a common point.

11. The printing system according to claim 10, wherein a second and third facet associated with the lower substantially triangular structure direct media sheets downwardly from two different directions to a common point.

12. The printing system according to claim 9, the input intersection transport comprising:

an input gate;

an upper output;

a lower output; and a bidirectional input and output gate, wherein the input gate selectively directs media sheets to the upper output, the lower output and the bidirectional input and output gate, and the bidirectional input and output gate selectively directs media sheets from the input gate to the bidirectional horizontal transport operating in forward, and selectively directs media sheets from the bidirectional horizontal transport operating in reverse to the upper output and lower output.

13. The printing system according to claim 12, the output intersection transport comprising:

an output;

an upper input gate;

a lower input gate; and a bidirectional input and output gate, wherein the upper input gate selectively directs media sheets to the bidirectional input and output gate, and the output, and the lower input gate selectively directs media sheets to the bidirectional input and output gate, and the output, and the bidirectional input and output gate selectively directs media sheets from the upper input gate to the bidirectional horizontal transport operating in reverse, from the lower input gate to the bidirectional horizontal transport operating in reverse, and from the bi-directional horizontal transport operating in a forward direction to the output.

14. The printing system according to claim 9, the output intersection transport comprising:

an output;

an upper input gate;

a lower input gate; and a bidirectional input and output gate, wherein the upper input gate selectively directs media sheets to the bidirectional input and output gate, and the output, and the lower input gate selectively directs media sheets to the bidirectional input and output gate, and the output, and the bidirectional input and output gate selectively directs media sheets from the upper input gate to the bidirectional horizontal transport operating in reverse, from the lower input gate to the bidirectional horizontal transport operating in reverse, and from the bi-directional horizontal transport operating in a forward direction to the output.

15. A xerographic printing system comprising:

a sheet input module;

an intersection transport module operatively connected to the sheet input module, the intersection transport module comprising:

an input intersection transport;

a single horizontal transport operatively connected to the input intersection transport; and an output intersection transport operatively connected to the single horizontal transport, one pair of marking engines operatively connected to the intersection transport module, the pair of marking engines comprising two substantially vertically aligned marking engines, wherein the respective input and output paths associated with the substantially vertically aligned marking engines are substantially vertically oriented, the pair includes an upper marking engine and a lower marking engine, and the respective upper and lower marking engine input and output Paths are operatively connected to the respective input intersection transport and output intersection transport; and a sheet output module operatively connected to the output intersection transport associated with the intersection transport module;

wherein the printing system further comprises:

two or more pairs of marking engines; and two or more intersection transport modules, wherein each pair of marking engines is operatively connected to a different intersection transport module.

16. A xerographic printing system comprising:

a sheet input module;

an intersection transport module operatively connected to the sheet input module, the intersection transport module comprising:

an input intersection transport;

a single horizontal transport operatively connected to the input intersection transport; and an output intersection transport operatively connected to the single horizontal transport, one pair of marking engines operatively connected to the intersection transport module, the pair of marking engines comprising two substantially vertically aligned marking engines, wherein the respective input and output paths associated with the substantially vertically aligned marking engines are substantially vertically oriented, the pair includes an upper marking engine and a lower marking engine, and the respective upper and lower marking engine input and output paths are operatively connected to the respective input intersection transport and output intersection transport; and a sheet output module operatively connected to the output intersection transport associated with the intersection transport module;

wherein the single horizontal transport is bidirectional.

* * * * *